US005465603A

United States Patent [19]

Anthony et al.

[11] Patent Number: 5,465,603

[45] Date of Patent: Nov. 14, 1995

[54] OPTICALLY IMPROVED DIAMOND WIRE DIE

[75] Inventors: Thomas R. Anthony, Schenectady, N.Y.; Bradley E. Williams, Worthington, Ohio; Karen M. McNamara, Clifton Park, N.Y.

[73] Assignee: General Electric Company, Worthington, Ohio

[21] Appl. No.: 148,803

[22] Filed: Nov. 5, 1993

[51] Int. Cl.[6] ..... B21C 3/02

[52] U.S. Cl. ..... 72/467; 423/446

[58] Field of Search ..... 72/467; 423/446; 156/DIG. 68; 51/309

[56] References Cited

U.S. PATENT DOCUMENTS

| | | | |
|---|---|---|---|
| 4,412,980 | 11/1983 | Tsuji | 423/446 |
| 4,707,384 | 11/1987 | Schachner | 72/467 |
| 5,110,579 | 5/1992 | Anthony et al. | 423/446 |
| 5,127,983 | 7/1992 | Imai | 423/446 |
| 5,271,971 | 12/1993 | Herb | 423/446 |
| 5,273,825 | 12/1993 | Herb | 423/446 |
| 5,310,447 | 5/1994 | Anthony et al. | 423/446 |

FOREIGN PATENT DOCUMENTS

| | | | |
|---|---|---|---|
| 0494799A1 | 1/1992 | European Pat. Off. | 72/467 |
| 57-011718 | 1/1982 | Japan . | |
| 59-229227 | 12/1984 | Japan . | |
| 63-052710 | 3/1988 | Japan . | |
| 1009882 | 1/1989 | Japan . | |

OTHER PUBLICATIONS

Article–The Properties of Natural and Synthetic Diamond–pp. 663–665.

Article–Properties and Applications of Diamond–pp. 504–507.

Article–The Abrasion of Diamond Dies Section A, vol. 5.

Article–Low Pressure Synthesis of Superhard Coatings.

Article–Low–Pressure Diamond Coatings for Tools and Wear Parts pp. 805–808.

Article–Properties and Applications of Diamond.

*Primary Examiner*—Daniel C. Crane

[57] ABSTRACT

A die for drawing wire of a predetermined diameter comprising an optically non-opaque CVD diamond body having a thermal conductivity greater than 4 watts/cm-K with an opening extending through said body and having a wire bearing portion of substantially circular cross-section determinative of the diameter of the wire.

5 Claims, 1 Drawing Sheet

OPTICALLY IMPROVED DIAMOND WIRE DIE

TECHNICAL FIELD OF THE INVENTION

The present invention relates to diamond wire dies.

BACKGROUND OF THE INVENTION

Wires of metals such as tungsten, copper, iron, molybdenum, and stainless steel are produced by drawing the metals through diamond dies. Single crystal diamond dies are difficult to fabricate, tend to chip easily, easily cleave, and often fail catastrophically because of the extreme pressures involved during wire drawing.

With reference to single crystal wire dies, it is reported in Properties and Applications of Diamond, Wilks et al, Butterworth-Heinemann Ltd 1991, pages 505–507: "The best choice of [crystallographic] direction is not too obvious because as the wire passes through the die its circumference is abrading the diamond on a whole 360° range of planes, and the rates of wear on these planes will be somewhat different. Hence, the originally circular hole will not only grow larger but will loose its shape. However, <110> directions offer the advantage that the wire is abrading the sides of the hole with { 001} and { 011} orientations in abrasion resistant directions."

Diamond dies which avoid some of the problems attendant with natural diamonds of poorer quality comprise microporous masses compacted from tiny crystals of natural or synthesized diamonds or from crystals of diamond. The deficiencies of such polycrystalline hard masses, as indicated in U.S. Pat. No. 4,016,736, are due to the presence of micro-voids/pores and soft inclusions. These voids and inclusions can be more than 10 microns in diameter. The improvement of the patent utilizes a metal cemented carbide jacket as a source of flowable metal which fills the voids resulting in an improved wire die.

European Patent Application 0 494 799 A1 describes a polycrystalline CVD diamond layer having a hole formed therethrough and mounted in a support. As set forth in column 2, lines 26–30, "The relatively random distribution of crystal orientations in the CVD diamond ensures more even wear during use of the insert." As set forth in column 3, lines 50–54, "The orientation of the diamond in the polycrystalline CVD diamond layer 10 may be such that most of the crystallites have a (111) crystallographic axis in the plane, i.e. parallel to the surfaces 14, 16, of the layer 10.

Other crystal orientations for CVD films are known. U.S. Pat. No. 5,110,579 to Anthony et al describes a transparent polycrystalline diamond film as illustrated in FIG. 3A, substantially transparent columns of diamond crystals having a <110> orientation perpendicular to the base.

Because of its high purity and uniform consistency, CVD diamond may be desirably used as compared to the more readily available and poor quality natural diamond. Because CVD diamond can be produced without attendant voids, it is often more desirable than polycrystalline diamond produced by high temperature and high pressure processes. However, further improvements in the structure of CVD wire drawing dies are desirable. Particularly, improvements in grain structure of CVD diamond wire die which tend to enhance wear and uniformity of wear are particularly desirable.

BRIEF SUMMARY OF THE INVENTION

Hence, it is desirable obtain a dense void-free CVD diamond wire die having a structure which provides for enhanced wear and uniformity of wear.

It has been found that the improved wire die of the present invention produced from a CVD substrate having improved optical properties, results in a wire die having low impurities with enhanced thermal conductivity, low fracture resistance, and improved toughness and resistance to diamond grain pullout.

Additional preferred properties of the diamond film include a thermal conductivity greater than about 4 watts/cm-K. Such wire dies have a enhanced wear resistance and cracking resistance which increases with increasing thermal conductivity.

In accordance with the present invention, there is provided a die for drawing wire of a predetermined diameter comprising an optically non-opaque CVD diamond body having a thermal conductivity greater than 4 watts/cm-K with an opening extending through said body and having a wire bearing portion of substantially circular cross-section determinative of the diameter of the wire.

Also, in accordance with preferred embodiments, the improved wire die of the present invention has a uniform small diamond grain structure throughout its cross section so that a plurality of diamond grains intersect the wire bearing portion. The small grain structure enhances toughness and reduces the propensity of diamond to cleave. Cracks, which are normally propagated along grain boundaries, tend to stop at adjacent grain boundaries. Also, with a small grain structure, chips caused by the pull out of diamond grains are not as likely to cause failure of the die.

In accordance with another preferred embodiment, the die for drawing wire has an opening extending entirely through the body along an axial direction from one surface to the other in an axial direction with diamond grains having a <110> orientation extending substantially along the axial direction. Other embodiments include other orientations for the film.

Also, other embodiments include the self-supporting film itself having a uniformly small diamond grain structure throughout its cross section.

DETAILED DESCRIPTION

Figure 1:
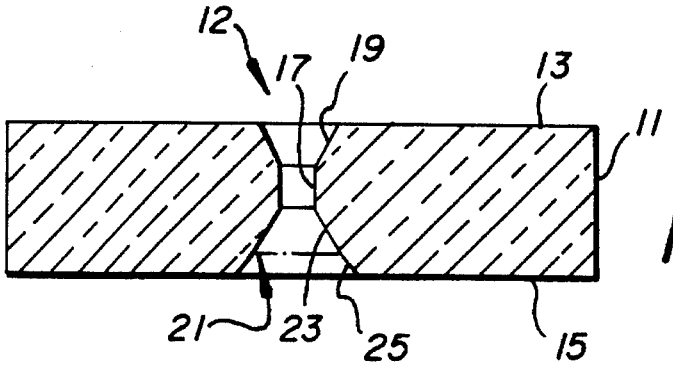
FIG. 1 is a cross-sectional view of a diamond wire die.

FIG. 1 illustrates a diamond wire die 11 produced from a CVD diamond layer. Such dies are typically cut from a CVD diamond layer which has been separated from a growth substrate. This layer may be thinned to a preferred thickness. The major opposing surfaces of the die blank may be planarized and/or thinned to the desired surface finish by mechanical abrasion or by other means such as laser polishing, ion thinning, or other chemical methods. Preferably, conductive CVD diamond layers can be cut by electro-discharge machining, while insulating films can be cut with a laser to form discs, squares, or other symmetrical shapes. When used for wire drawing, the outer periphery of the die 11 is mounted in a support so as to resist axially aligned forces due to wire drawing.

As shown in more detail in FIG. 1, the wire die 11 includes an opening 12 aligned along an axis in a direction normal to spaced apart parallel flat surfaces 13 and 15. For purposes of description, surface 13 is hereinafter referred as the top surface and surface 15 is referred to as the bottom surface 15. The opening 12 is of an appropriate size which is determined by the desired size of the wire. The straight bore section 17 of opening 12 includes has a circular cross section which is determinative of the desired final diameter of the wire to be drawn. From the straight bore section 17, the opening 12 tapers outwardly at exit taper 19 toward the top surface 13 and at entrance taper 21 toward the bottom surface 15. The wire to be drawn initially passes through entrance taper 21 where an initial size reduction occurs prior to passing through the straight bore section 17 and exit taper 19.

The entrance taper 21 extends for a greater distance along the axial direction than exit taper 19. Thus, the straight bore section 17 is closer to top surface 13 than to bottom surface 15. Entrance taper 21 includes a wide taper 25 opening onto the bottom surface 15 and narrow taper 23 extending between the straight bore 17 and the wider taper 25.

The opening 12 may be suitably provided by first piercing a pilot hole with a laser and then utilizing a pin ultrasonically vibrated in conjunction with diamond grit slurry to abrade an opening 12 by techniques known in the art.

Typical wire drawing dies have a disc-shape although square, hexagonal octagonal, or other polygonal shapes may be used. Preferably, wire dies have a thickness of about 0.4–10 millimeters. The length measurement as in the case of a polygonal shape or the diameter measurement as in the case of a rounded shape, is preferably about 1–20 millimeters. The preferred lengths are from 1–5 millimeter. The opening or hole 12 suitable for drawing wire typically has a diameter from 0.030 mm to 5.0 mm. Wire dies as prepared above, may be used to draw wire having desirable uniform properties. The wire die may contain more than one hole, and these holes may or may not be the same diameter and shape.

A technique for forming a diamond substrate is set forth in U.S. Pat. No. 5,110,579 to Anthony et al. According to the processes set forth in the patent, diamond is grown by chemical vapor deposition on a substrate such as molybdenum by a filament process. According to this process, an appropriate mixture such as set forth in the example is passed over a filament for an appropriate length of time to build up the substrate to a desired thickness and create a diamond film. As set forth in the patent, a preferred film is substantially transparent columns of diamond crystals having a <110> orientation perpendicular to the base. Grain boundaries between adjacent diamond crystals having hydrogen atoms saturating dangling carbon bonds is preferred wherein at least 50 percent of the carbon atoms are believed to be tetrahedral bonded based on Raman spectroscopy, infrared and X-ray analysis. It is also contemplated that H, F, Cl, O or other atoms may saturate dangling carbon atoms.

Figure 2:
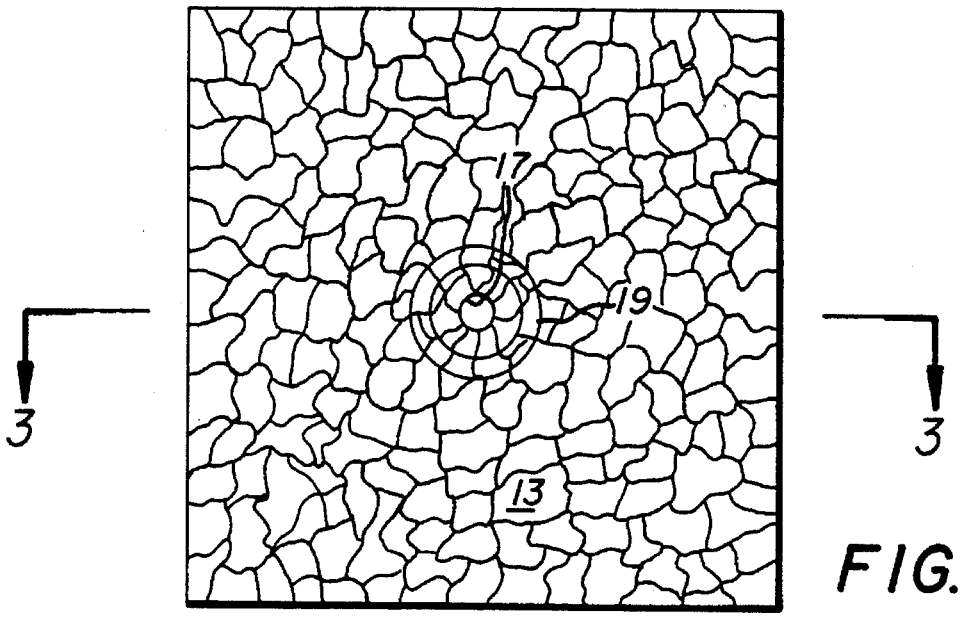
FIG. 2 is an enlarged top-view of a portion of the wire die shown in FIG. 1.
Figure 3:
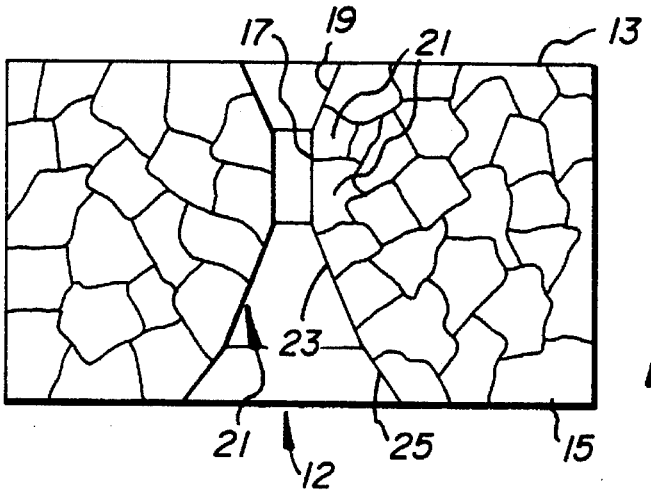
FIG. 3 is a cross-sectional view of the wire die portion shown in FIG. 2.

The view as illustrated in FIGS. 2 and 3 of the polycrystalline diamond film in respective cross sections further illustrates the grain structure of the diamond film. The wire bearing portion is within a plurality of small diamond grains and the diamond body uniformly consist of small diamond grains. To obtain the small diamond grains, the process as set forth in U.S. Pat. No. 5,110,579 is modified so as to continuously reseed the diamond film during the deposition process. According to one technique, nucleating dopants such as silicon tetrachloride, boron, germanium, or carbide formers such as titanium, hafnium may be added to the CVD gas.

The preferred process in accordance with the principles of the present invention maintains the amount of impurities at a very low level. Preferably, the diamond film utilized for the wire die of the present invention consist entirely of diamond. Hydrogen, oxygen, and nitrogen are not considered impurities or intentional additives and are desirable present in amounts greater than the 1 part per million level. Additional ingredients in the form of impurities and intentional additives are preferably present in amounts less than 4000 parts per million by weight, and more preferably less than 100 parts per million. Hence, it is preferable to nucleate the diamond crystals during the deposition process by a technique which does not add deleterious materials to the substrate.

Techniques for reseeding or continuously nucleating diamond without the addition of impurities or deleterious materials, include cycling the carbon concentration or hydrogen concentration in the CVD gas, reducing the nitrogen concentration, and increasing the substrate temperature. A preferred technique comprises applying a bias voltage to the substrate during the deposition process. This technique may be utilized in conjunction with the filament process as described above in U.S. Pat. No. 5,110,579 and copending continuation-in-part application Ser. No. 07/859,753 to Anthony et al, entitled Substantially Transparent Free Standing Diamond Films.

According to the biasing technique, the deposition apparatus includes a deposition chamber electrically isolated from the substrate. An electrical bias voltage is provided between the substrate and the chamber walls such as by a DC power supply. Preferably the substrate is given the more positive bias voltage to promote the growth of smaller crystallites. Bias voltages in the range of about 25 volts may be effectively utilized. It is also contemplated that the bias voltage may be pulsed. For the microwave CVD diamond process, an analogous biasing technique can also be used. In this case, the substrate is biased negatively from 0–300 volts rather than positively as was the case for the hot filament.

The resulting diamond film preferably has uniform grain or size of crystals of less than about 5 micron, preferably less than about 2 micron. Submicron grains are considered within the scope of the present invention. The diamond film preferably has a thermal conductivity of at least about 6 W/cm-K, more preferably at least about 9 W/cm-K. Thermal conductivity of the diamond film may be as high as about 21 W/cm-K. Such wire dies have an enhanced wear resistance and cracking resistance which increases with increasing thermal conductivity. Techniques which can be used to measure thermal conductivity of the substantially transparent diamond film are by Mirage, shown by R. W. Pryor et al., proceedings of the Second International Conference on New Diamond Science and Technology, p. 863 (1990).

As result of high thermal conductivity properties, the wire dies of the present invention are capable of rapidly dissipating heat that is created during wire drawing. Other favorable properties include an electrical resistivity less than 1000 ohm-cm to greater than 1,000,000 ohm-cm at room temperature.

Although the diamond film can transmit light, the polycrystalline nature of the film can result in light scatter which can interfere with clarity. In addition, a material of high refractive index can reflect incident light which also contributes to a reduction in transmittance. Transmittance can be converted to absorbance which is a quantitative relationship similar to the Beers-Lambert Law as follows:

$$I/I_o = e^{-kb}$$

where $I_o$ is the incident light, I is the transmitted light, b is the diamond thickness and k is the absorption coefficient.

The light absorbance of a material capable of transmitting light is defined by the formula:

$$A=-log(I/I_o)$$

Percent transmission "% T" is defined as:

$$\%T=100\%(I/I_o)$$

However, the %T of diamond film is difficult to calculate directly because as previously indicated, scattering and reflectance must be considered. The apparent transmission $T_A$ of a diamond film can be calculated if the amount of transmitted light which includes both unscattered "$I_u$" and scattered "$I_s$", can be measured. The $T_A$ then can be calculated as follows:

$$T_A=(Iu+I_s)/I_o$$

The % T can be calculated from $T_A$ if the reflectance "R" can be measured as shown as follows:

$$\%T=(T_A\times 100)/(100-R)$$

A graph showing the absorbance corrected for both scatter and reflectance of a 300 micron diamond film which resulted from the transmission of light over the range of about 300 nm to about 2500 nm is set forth in copending application Ser. No. 07/859,753 mentioned above.

The diamond film utilized for the wire die of the present invention is non-opaque at thicker thicknesses within the range of 0.4–10 millimeters. The substrate preferably has an absorbance of less than about 1.6 when using light having a wavelength in the range between about 300 to 1400 nanometers. Over this range, the absorbance decreases linearly from about 1.6 to 0.2 as the wavelength increases from 300 to 1400 nanometers. The absorbance decreases from 0.2 to less than 0.1 as the wavelength increases from about 1400 nm to about 2400 nm.

The diamond crystals typically have a <110> orientation perpendicular to the bottom surface. The diamond grains may have a random orientation both parallel to the opening and perpendicular to the axial direction of the opening. If the grain size of the CVD diamond is sufficiently small, random crystallographic orientations may be obtained. The preferred film utilized in the present invention has the properties described above including, grain boundaries between adjacent diamond crystals preferably have hydrogen atoms saturating dangling carbon bonds as illustrated in the patent. The transparent CVD diamond typically has a hydrogen concentration of less than 1000 ppm. The concentrations of hydrogen in atomic percent are typically from 10 ppm to about 1000 ppm, preferably from about 10 ppm to 500 ppm.

The micro-graphic structure is illustrated in FIG. 3. The initial vapor deposition of diamond on the substrate results in the seeding of diamond grains or individual diamond crystals. As the individual crystals growth in an axial direction, the electrical biasing or other preferred technique causes renucleation of the diamond grains so that a uniformly small diamond grains are maintained throughout the body. Otherwise, without the renucleation the cross sectional area of the diamond grains as measured along planes parallel to the top and bottom surfaces, 13 and 15, would increase. The diamond body preferably has no voids greater than 10 microns in diameter or inclusions of another material or carbon phase.

In accordance with the preferred embodiment of the present invention, the straight bore section 17 is preferably substantially entirely within a plurality of diamond grains. As illustrated in FIG. 3, the interior wall or surface of the straight bore 17 intersects and is positioned interior to a plurality of diamond grains illustrated at 27. The <110> preferred grain direction is preferably perpendicular to the major plane of the film and a randomly aligned grain direction about the <110>. As previously discussed, if the gain size is sufficiently small, random crystallographic orientations may be obtained.

The film is preferably non-opaque or transparent or translucent and contains oxygen in atomic percent greater than 1 part per billion. The film also contains hydrogen in atomic percent greater than 10 parts per million. The diamond film preferably may contain impurities and intentional additives. Impurities may be in the form of catalyst material such as iron, nickel, or cobalt. The film contains less than 10 parts per million in atomic percent of Fe, Ni or Co which are the catalyst materials used in the competing high-pressure high-temperature diamond synthesis process. Nitrogen can also be incorporated into the CVD diamond film in atomic percent from between 0.1 to 1000 parts per million.

Diamond deposition on substrates made of Si, Ge, Nb, V, Ta, Mo, W, Ti, Zr or Hf results in CVD diamond wire die blanks that are more free of defects such as cracks than other substrates. By neutron activation analysis, we have found that small amounts of these substrate materials are incorporated into the CVD diamond films made on these substrates. Hence, the film may contain greater than 10 parts per billion and less than 10 parts per million of Si, Ge, Nb, V, Ta, Mo, W, Ti, Zr or Hf. Additionally, the film may contain more than one part per million of a halogen, i.e. fluorine, chlorine, bromine, or iodine. Additional additives may include N, B, O, and P which may be present in the form of intentional additives. It's anticipated that films that can be utilized in the present invention may be made by other processes, such as by microwave diamond forming processes.

It is contemplated that CVD diamond having such preferred conductivity may be produced by other techniques such as microwave CVD, RFCVD, DCjet CVD, or combustion flame CVD. Boron can be an intentional additive that is used to reduce intrinsic stress in the CVD diamond film or to improve the oxidation resistance of the film. It would be present in atomic percent from between 1–4000 ppm. Intentional additives may include N, S, Ge, Al, and P, each at levels less than 100 ppm. It is contemplated that suitable films may be produced at greater levels. Lower levels of impurities tend to favor desirable wire die properties of toughness and wear resistance. The most preferred films contain less than 5 parts per million and preferably less than 1 part per million impurities and intentional additives. In this regard, hydrogen, nitrogen, and oxygen are not regarded as intentional additives or impurities since these ingredients are the result of the process.

We claim:

1. A die for drawing wire comprises (1) a substantially transparent polycrystalline CVD diamond body having a thermal conductivity greater than 4 watts/cm-k and a uniform small diamond grain structure of less than about 5 microns throughout its cross section and an opening for receiving wire fed through said opening during drawing, and (2) a support body for supporting the diamond body, whereby the wear resistance of said die is substantially improved.

2. The die according to claim 1, wherein said body comprises diamond crystals having a <110> orientation perpendicular to a base surface of the diamond body.

3. A die for drawing wire in accordance with claim 1 having a thermal conductivity of at least about 6 W/cm-K.

4. A die for drawing wire in accordance with claim 3 having a thermal conductivity of at least about 9 W/cm-K.

5. A die for drawing wire in accordance with claim 4 having a thermal conductivity about 21 W/cm-K.

* * * * *